US010084276B2

(12) United States Patent
Matsuo et al.

(10) Patent No.: US 10,084,276 B2
(45) Date of Patent: Sep. 25, 2018

(54) WATERPROOF TERMINAL STRUCTURE AND ELECTRONIC DEVICE MODULE

(71) Applicant: Japan Aviation Electronics Industry, Limited, Tokyo (JP)

(72) Inventors: Seiya Matsuo, Tokyo (JP); Akihiro Matsunaga, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/801,895

(22) Filed: Nov. 2, 2017

(65) Prior Publication Data

US 2018/0219342 A1 Aug. 2, 2018

(30) Foreign Application Priority Data

Jan. 30, 2017 (JP) ..... 2017-014400

(51) Int. Cl.

| | |
|---|---|
| ***H01R 13/648*** | (2006.01) |
| ***H01R 12/57*** | (2011.01) |
| ***H01R 33/965*** | (2006.01) |
| ***H01R 13/52*** | (2006.01) |
| *H01R 13/11* | (2006.01) |

(52) U.S. Cl.

CPC ..... *H01R 33/965* (2013.01); *H01R 13/521* (2013.01); *H01R 13/11* (2013.01)

(58) Field of Classification Search

CPC .... H01R 12/57; H01R 13/648; H01R 13/521; H01R 23/7073; H01R 13/04; H01R 43/16; H01R 9/091; H01R 13/65802; H01R 13/6658; H01R 23/725

USPC ..... 439/587–589, 95, 76.1, 78, 81, 83, 884, 439/891

See application file for complete search history.

(56) References Cited

U.S. PATENT DOCUMENTS

| | | | | |
|---|---|---|---|---|
| 4,846,698 | A * | 7/1989 | Staiger | F16J 15/02 439/271 |
| 2008/0113529 | A1* | 5/2008 | Kim | F25D 29/005 439/76.1 |
| 2010/0142744 | A1* | 6/2010 | Rombach | H04R 19/00 381/355 |
| 2014/0038458 | A1* | 2/2014 | Bausch | H01R 12/714 439/587 |

(Continued)

FOREIGN PATENT DOCUMENTS

JP 2009-059586 A 3/2009

*Primary Examiner* — Gary Paumen

(74) *Attorney, Agent, or Firm* — Muncy, Geissler, Olds & Lowe, P.C.

(57) ABSTRACT

A waterproof terminal structure includes a contact having a spring contact point, and a terminal member that holds the contact, the terminal member including a contact connection portion having conductivity and connected to the contact, a seal portion tightly attached to an insulating waterproof member disposed at least along a circumference of an opening of a housing, and a substrate mount portion having conductivity and connected to a wiring portion of a substrate, the contact connection portion and the substrate mount portion being electrically connected to each other and positioned such that a water entering path from the contact connection portion toward the substrate mount portion is cut by the seal portion, the contact not penetrating the terminal member.

7 Claims, 8 Drawing Sheets

(56) References Cited

U.S. PATENT DOCUMENTS

| | | | | |
|---|---|---|---|---|
| 2016/0141775 | A1* | 5/2016 | Loibl | H01R 13/5219<br>439/83 |
| 2017/0213068 | A1* | 7/2017 | Chang | G06K 9/00087 |

* cited by examiner

WATERPROOF TERMINAL STRUCTURE AND ELECTRONIC DEVICE MODULE

BACKGROUND OF THE INVENTION

The present invention relates to a waterproof terminal structure, particularly to a waterproof terminal structure including a contact having a spring contact point.

The present invention also relates to an electronic device module capable of preventing water from entering the inside of a housing.

A waterproof terminal structure that has a waterproof function despite the presence of an elastically-displaceable spring contact point is disclosed in, for instance, JP 2009-59586 A. The waterproof terminal structure includes movable contact point terminals 2 disposed in a housing 1 and elastic seal members 3 of diaphragm shape separately fixed to the movable contact point terminals 2, as shown in FIG. 24. The movable contact point terminals 2 each have a tubular body 4 and a movable pin 5 that is incorporated in the tubular body 4 to be movable therein along an axial direction. The movable pin 5 is disposed to project outward from the housing 1 through an opening 6 of the housing 1.

A through-hole 7 is formed in the center of each elastic seal member 3. With the movable pin 5 penetrating the through-hole 7, the elastic seal member 3 and the movable pin 5 are tightly attached and fixed to each other, while the elastic seal member 3 is fitted in the opening 6 of the housing 1 such that the outer peripheral portion of the elastic seal member 3 is tightly attached and fixed to the opening 6 of the housing 1. The elastic seal member 3 elastically deforms as following the movement of the movable pin 5 along the axial direction.

Having the elastic seal member 3 as above makes it possible to prevent water from entering the inside of the housing 1 while allowing the movement of the movable pin 5 that projects from inside to outside of the housing 1 through the opening 6.

Since, however, the movable pin 5 of the movable contact point terminal 2 penetrates the through-hole 7 of the elastic seal member 3 in the waterproof terminal structure of JP 2009-59586 A, water may go through not only the interface between the outer peripheral portion of the elastic seal member 3 and the opening 6 of the housing 1 but also the interface between the through-hole 7 of the elastic seal member 3 and the outer peripheral portion of the movable pin 5, and thus it is difficult to have an excellent waterproof function.

In addition, since the movable pin 5 of the movable contact point terminal 2 is movable along the axial direction, peel-off is likely to occur between the through-hole 7 of the elastic seal member 3 and the outer peripheral portion of the movable pin 5, which may impair a waterproof function.

SUMMARY OF THE INVENTION

The present invention is aimed at solving the conventional problems as above and providing a waterproof terminal structure having an excellent waterproof function despite the presence of a contact having a spring contact point.

The present invention is also aimed at providing an electronic device module having an excellent waterproof function.

A waterproof terminal structure according to the present invention includes a contact having a spring contact point, the waterproof terminal structure comprising:

a terminal member that holds the contact, the terminal member including:

a contact connection portion having conductivity and connected to the contact;

a seal portion tightly attached to an insulating waterproof member disposed at least along a circumference of an opening of a housing; and a substrate mount portion having conductivity and connected to a wiring portion of a substrate, wherein the contact connection portion and the substrate mount portion are electrically connected to each other and positioned such that a water entering path from the contact connection portion toward the substrate mount portion is cut by the seal portion, and wherein the contact does not penetrate the terminal member.

An electronic device module comprises:

a housing having an opening;

an insulating waterproof member disposed at least along a circumference of the opening of the housing;

a substrate disposed in the housing and having on its surface a wiring portion;

a terminal member fixed to the substrate; and a contact having a spring contact point and held in the terminal member, without penetrating the terminal member, such that the spring contact point is exposed through the opening of the housing, the terminal member including:

a contact connection portion having conductivity and connected to the contact;

a seal portion tightly attached to the insulating waterproof member; and a substrate mount portion having conductivity and connected to the wiring portion of the substrate, wherein the contact connection portion and the substrate mount portion are electrically connected to each other, and a water entering path from the contact connection portion toward the substrate mount portion is cut by the seal portion, and wherein water is prevented from entering an inside of the housing by tightly attaching the seal portion of the terminal member to the insulating waterproof member.

DETAILED DESCRIPTION OF THE INVENTION

Embodiments of the present invention are described below based on the appended drawings.

Embodiment 1

Figure 1:
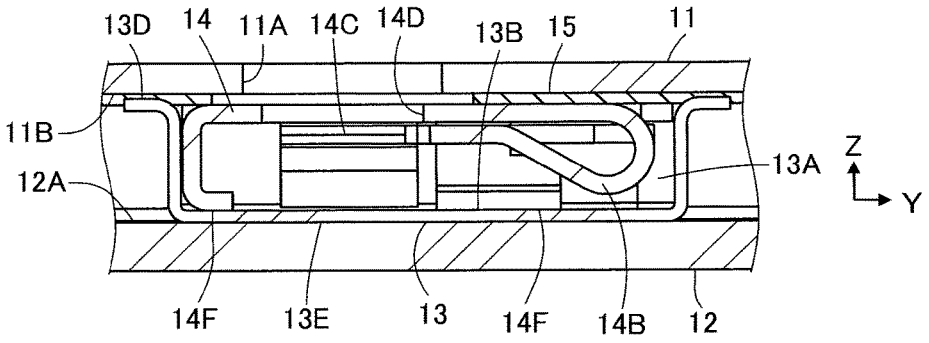
FIG. 1 is a cross-sectional view showing a waterproof terminal structure according to Embodiment 1 of the present invention.

FIG. 1 shows a waterproof terminal structure according to Embodiment 1. The waterproof terminal structure has a structure in which a terminal member 13 is fixed to a substrate 12 disposed in a housing 11 and a contact 14 is held in the terminal member 13.

The housing 11 has an opening 11A, and a sheet type, insulating waterproof member 15 is disposed on an inner surface 11B of the housing 11 that faces inward of the housing 11, along the circumference of the opening 11A so as to surround the opening 11A.

The substrate 12 lies parallel to the inner surface 11B of the housing 11, and the terminal member 13 is disposed between a surface 12A of the substrate 12 and the waterproof member 15.

For convenience, the inner surface 11B of the housing 11 is defined as extending along an XY plane, and the direction from the surface 12A of the substrate 12 toward the inner surface 11B of the housing 11 that is perpendicular to the inner surface 11B of the housing 11 is called "+Z direction."

Figure 2:
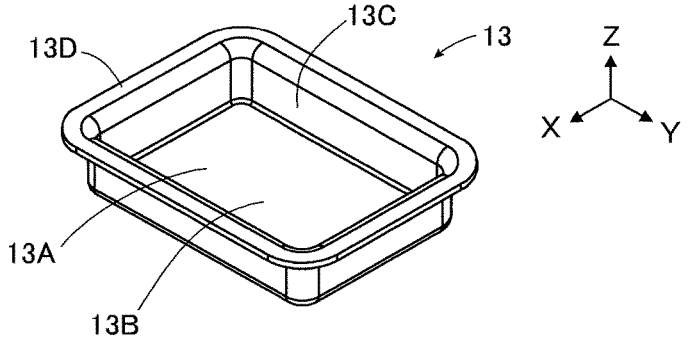
FIG. 2 is a perspective view of a terminal member used in the waterproof terminal structure according to Embodiment 1 as viewed from obliquely above.

As shown in FIG. 2, the terminal member 13 includes a contact accommodation portion 13A dented in a recess shape, has a box shape that opens upward in the +Z direction, that is, a so-called bathtub shape, and is formed from a sheet made of a conductive material such as metal. The contact accommodation portion 13A does not have any through-hole in its bottom surface 13B and side surfaces 13C and opens at its top.

The terminal member 13 also includes a flange 13D that lies along the circumference of the contact accommodation portion 13A and overhangs from the edge of the contact accommodation portion 13A to extend in an XY plane in parallel to the bottom surface 13B.

The bottom surface 13B of the contact accommodation portion 13A facing in the +Z direction forms a contact connection portion having conductivity, and the surface of the flange 13D facing in the +Z direction forms a seal portion of the terminal member 13.

Figure 3:
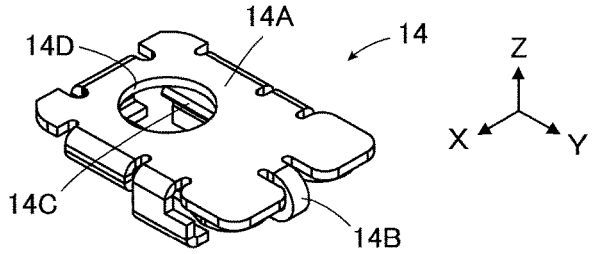
FIG. 3 is a perspective view of a contact used in the waterproof terminal structure according to Embodiment 1 as viewed from obliquely above.
Figure 4:
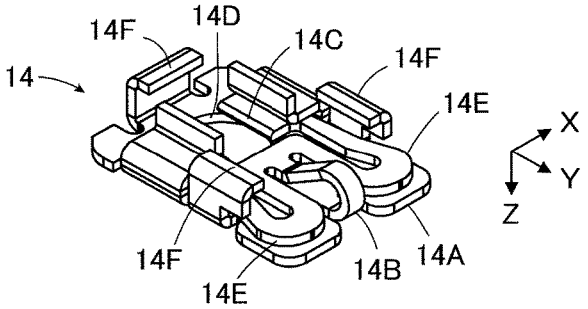
FIG. 4 is a perspective view of the contact used in the waterproof terminal structure according to Embodiment 1 as viewed from obliquely below.

The contact 14 is to be accommodated in the contact accommodation portion 13A of the terminal member 13. The contact 14 is formed from a bent metal sheet, and as shown in FIGS. 3 and 4, includes a base portion 14A having a flat portion extending along an XY plane, an arm portion 14B extending, as bending, from the +Y directional edge of the base portion 14A to the −Z directional side of the base portion 14A, and a pair of contact point portions (spring contact points) 14C disposed at tips of the arm portion 14B and facing each other in the X direction.

The base portion 14A has an opening 14D that is located on the −Y directional side so as to correspond to the opening 11A of the housing 11. The arm portion 14B includes a pair of flexible deformation portions 14E branching in the +X and −X directions to hold the corresponding contact point portions 14C, and the pair of contact point portions 14C are configured to be elastically displaceable in the X direction.

The contact 14 further includes three terminal member connection portions 14F located in the same XY plane.

Figure 5:
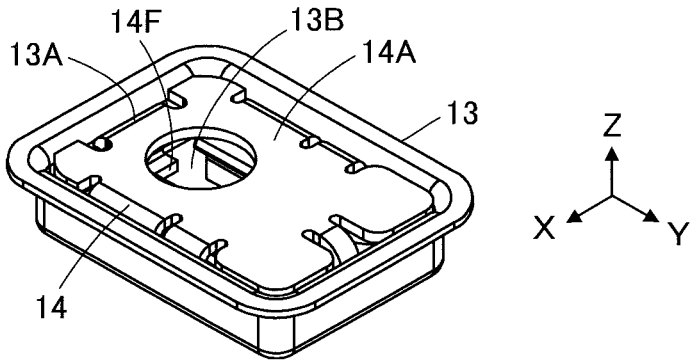
FIG. 5 is a perspective view of the terminal member in which the contact is incorporated in Embodiment 1 as viewed from obliquely above.

As shown in FIG. 5, the contact 14 is accommodated in the contact accommodation portion 13A of the terminal member 13. At this time, the contact 14 is disposed such that the three terminal member connection portions 14F of the contact 14 are connected to the bottom surface 13B of the contact accommodation portion 13A of the terminal member 13 and the base portion 14A of the contact 14 is exposed at the opening top of the contact accommodation portion 13A so as to face in the +Z direction.

Figure 6:
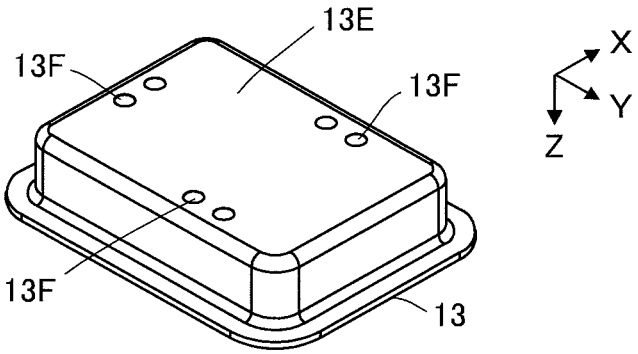
FIG. 6 is a perspective view of the terminal member in which the contact is incorporated in Embodiment 1 as viewed from obliquely below.

As shown in FIG. 6, the three terminal member connection portions 14F of the contact 14 are welded to the bottom surface 13B of the contact accommodation portion 13A of the terminal member 13 from the side of an outer surface 13E, facing in the −Z direction, of the contact accommodation portion 13A of the terminal member 13 by, with laser beams, irradiating welding sites 13F defined on the outer surface 13E in positions corresponding to the three terminal member connection portions 14F of the contact 14. Thus the contact 14 is electrically connected to the bottom surface 13B of the terminal member 13 that forms the contact connection portion.

Figure 7:
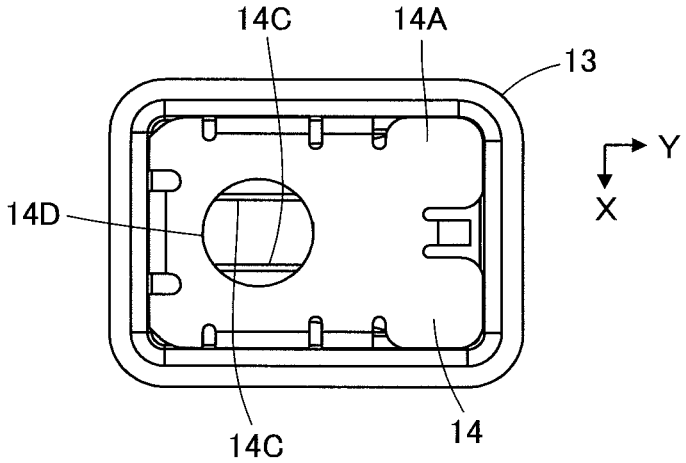
FIG. 7 is a plan view showing the terminal member in which the contact is incorporated in Embodiment 1.

As shown in FIG. 7, the pair of contact point portions 14C of the contact 14 are exposed through the opening 14D of the base portion 14A when viewed from the +Z direction.

The outer surface 13E of the contact accommodation portion 13A facing in the −Z direction forms a substrate mount portion having conductivity, and as shown in FIG. 1, the outer surface 13E of the contact accommodation portion 13A is soldered to a wiring portion (not shown) on the surface 12A of the substrate 12.

In other words, the sheet constituting the terminal member 13 has a pair of surfaces facing in the opposite directions; and the bottom surface 13B of the contact accommodation portion 13A that is constituted of, of the pair of surfaces, one surface forms the contact connection portion having conductivity, while the outer surface 13E of the contact accommodation portion 13A that is constituted of the other surface forms the substrate mount portion having conductivity.

Since the bottom surface 13B of the contact accommodation portion 13A forming the contact connection portion and the outer surface 13E of the contact accommodation portion 13A forming the substrate mount portion are electrically connected to each other via the inside of the conductive sheet constituting the terminal member 13, the contact 14 fixed to the bottom surface 13B of the contact accommodation portion 13A is electrically connected to the wiring portion of the substrate 12 via the terminal member 13 accordingly.

The substrate 12 is disposed in the housing 11 such that the surface of the flange 13D of the terminal member 13 that faces in the +Z direction and forms the seal portion is pressed against and tightly attached to the sheet type, insulating waterproof member 15 disposed on the inner surface 11B of the housing 11. The bottom surface 13B of the contact accommodation portion 13A forming the contact connection portion and the outer surface 13E of the contact accommodation portion 13A forming the substrate mount portion are positioned such that paths through which water may enter, i.e., water entering paths are all cut by the surface of the flange 13D forming the seal portion. In other words, water cannot go from the bottom surface 13B of the contact accommodation portion 13A to the outer surface 13E of the contact accommodation portion 13A along any surface of the sheet constituting the terminal member 13 without passing the surface of the flange 13D.

The surface of the flange 13D of the terminal member 13 is tightly attached to the waterproof member 15 and therefore, even when water goes from the outside of the housing 11 into the contact accommodation portion 13A of the terminal member 13 through the opening 11A, water is blocked by the terminal member 13 and thus prevented from reaching the substrate 12 located more inward than the terminal member 13 in the housing 11.

Since the contact 14 does not penetrate the terminal member 13, only the interface between the flange 13D of the terminal member 13 and the waterproof member 15 may provide a route allowing water to enter the inside of the housing 11, and blocking this route leads to an excellent waterproof function.

When a contact (non-spring contact point) of, for instance, pin shape of a counter connector (not shown) is inserted into the waterproof terminal structure shown in FIG. 1 through the opening 11A of the housing 11 from the +Z direction toward the −Z direction, the contact of the counter connector goes in the −Z direction while elastically deforming the pair of flexible deformation portions 14E such that the distance between the pair of contact point portions 14C of the contact 14 increases in the X direction, and then comes into contact with the pair of contact point portions 14C of the contact 14 at a predetermined contact pressure. As a result, the contact of the counter connector is electrically connected to the wiring portion (not shown) of the substrate 12 via the contact 14 and the terminal member 13.

Embodiment 2

Figure 8:
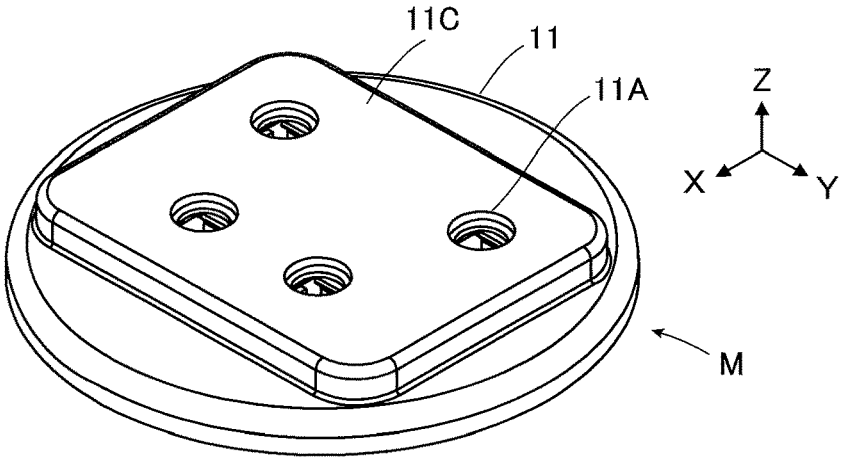
FIG. 8 is a perspective view of an electronic device module according to Embodiment 2 as viewed from obliquely above.
Figure 9:
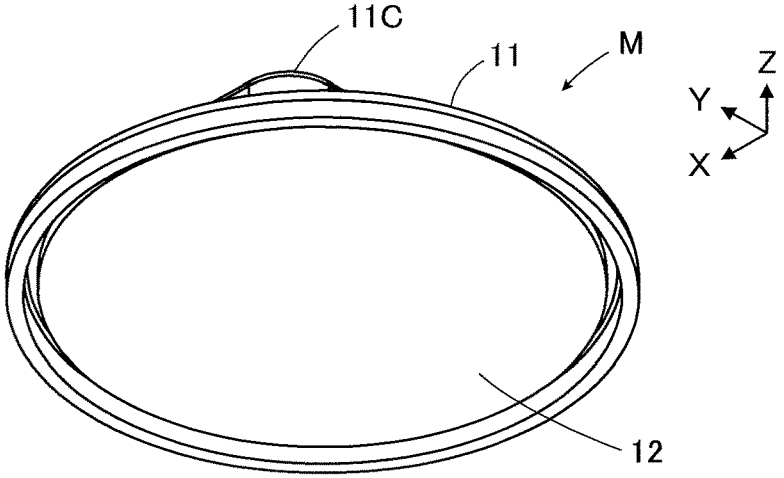
FIG. 9 is a perspective view of the electronic device module according to Embodiment 2 as viewed from obliquely below.
Figure 10:
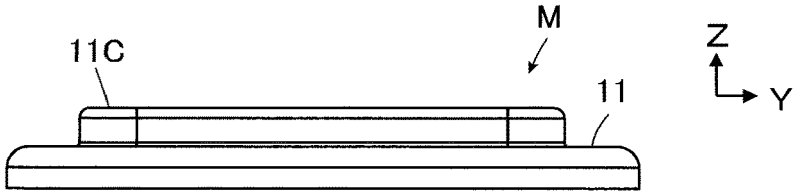
FIG. 10 is a front view showing the electronic device module according to Embodiment 2.

An electronic device module M according to Embodiment 2 is shown in FIGS. 8 to 10. The electronic device module M includes a housing 11 made of an insulating material such as an insulating resin, a substrate 12 disposed in the housing 11, and four contacts 14 fixed to the substrate 12.

Figure 11:
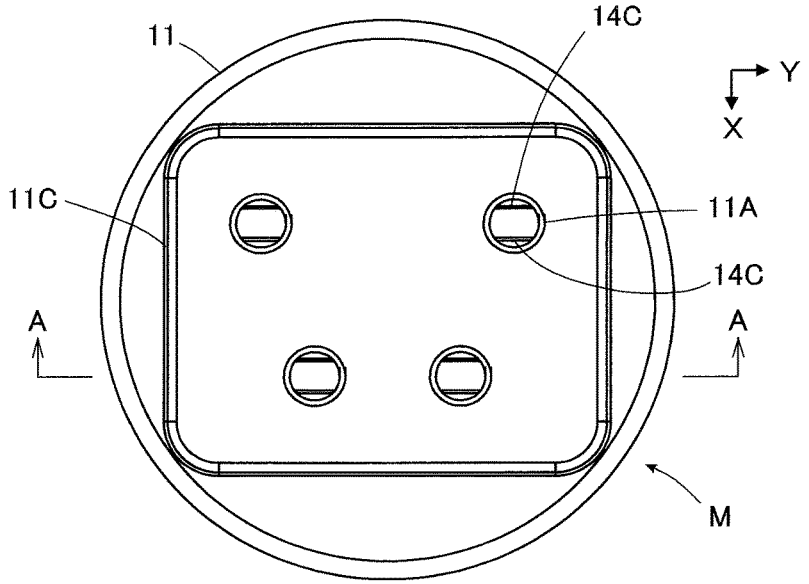
FIG. 11 is a plan view showing the electronic device module according to Embodiment 2.

The housing 11 has a raised portion 11C of substantially rectangular shape that projects in the Z direction perpendicular to the substrate 12 so as to extend away from the substrate 12, and the raised portion 11C has four openings 11A corresponding to the four contacts 14. As shown in FIG. 11, pairs of contact point portions 14C of the four contacts 14 are exposed through the corresponding openings 11A of the housing 11.

Figure 12:
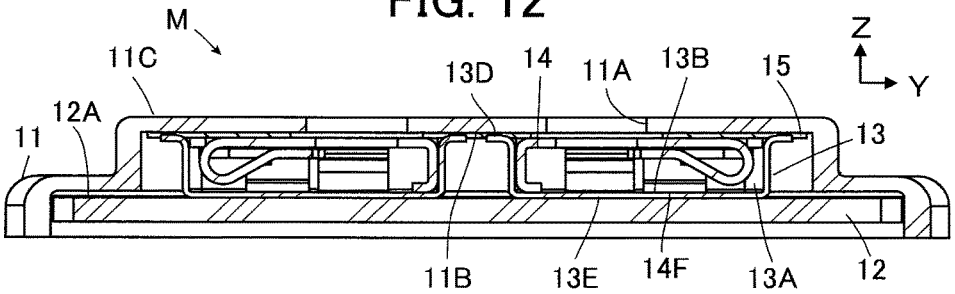
FIG. 12 is a cross-sectional view taken along line A-A in FIG. 11.

Corresponding to the four contacts 14, four waterproof terminal structures each identical to the waterproof terminal structure of Embodiment 1 shown in FIG. 1 are provided in the housing 11, as shown in FIG. 12.

That is, each contact 14 is accommodated in the contact accommodation portion 13A of the corresponding terminal member 13 having a so-called bathtub shape, and the terminal member connection portions 14F of each contact 14 are welded to the bottom surface 13B of the contact accommodation portion 13A of the corresponding terminal member 13. The outer surface 13E of the contact accommodation portion 13A of each terminal member 13 is soldered to a wiring portion (not shown) on a surface 12A of the substrate 12, and the surface of the flange 13D of each terminal member 13 is tightly attached to the sheet type, insulating waterproof member 15 disposed on the inner surface 11B of the raised portion 11C of the housing 11.

In each of the terminal members 13 in the four waterproof terminal structures, the bottom surface 13B of the contact accommodation portion 13A forming the contact connection portion and the outer surface 13E of the contact accommodation portion 13A forming the substrate mount portion are positioned such that water entering paths are all cut by the surface of the flange 13D forming the seal portion. As a result, even when water goes from the outside of the housing 11 into any of the contact accommodation portions 13A of the terminal members 13 through the four openings 11A, water is blocked by the terminal members 13 and thus prevented from reaching the substrate 12 located more inward than the terminal members 13 in the housing 11.

Figure 13:
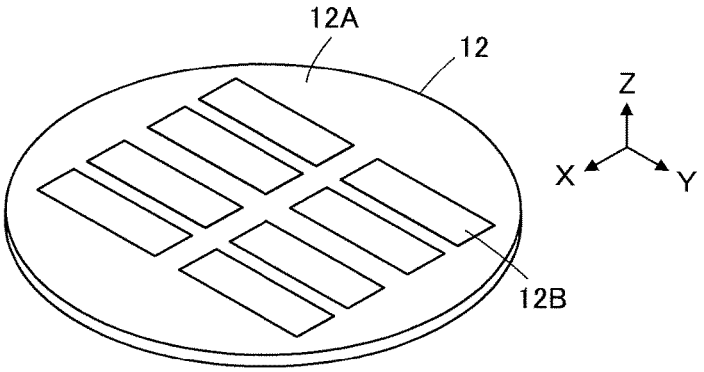
FIG. 13 is a perspective view of a substrate used in the electronic device module according to Embodiment 2 as viewed from obliquely above.
Figure 14:
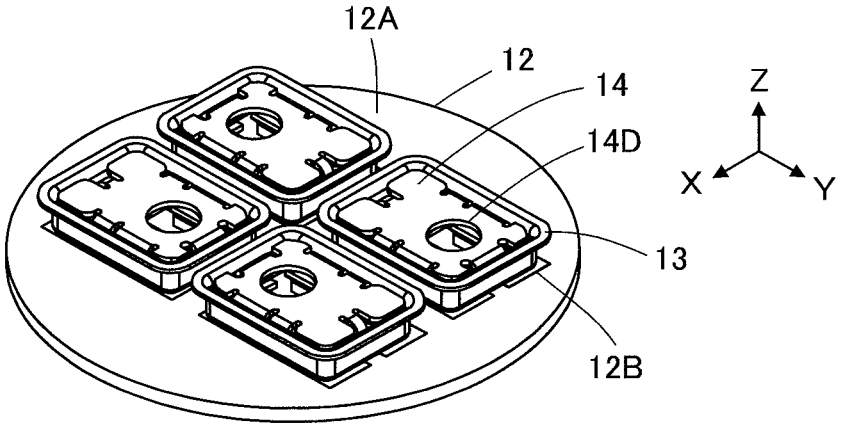
FIG. 14 is a perspective view showing the substrate on which a plurality of terminal members each having a contact incorporated therein are mounted.

The electronic device module M as above can be manufactured in the following manner, for example. The four terminal members 13 each having the contact 14 fixed thereto by welding as shown in FIG. 5 are soldered to corresponding wiring portions 12B arranged on the surface 12A of the substrate 12 as shown in FIG. 13. At this time, as shown in FIG. 14, the four contacts 14 are arranged two by two in two lines in an XY plane along the surface 12A of the substrate 12 such that each two contacts 14 adjacent to each other in the X direction are oppositely oriented in the Y direction, with the same applying to each two contacts 14 adjacent to each other in the Y direction. As thus arranged, the openings 14D of the four contacts 14 are located to have rotational asymmetry with respect to the Z axis perpendicular to the surface 12A of the substrate 12, more specifically, at the four vertexes of an isosceles trapezoid.

Figure 15:
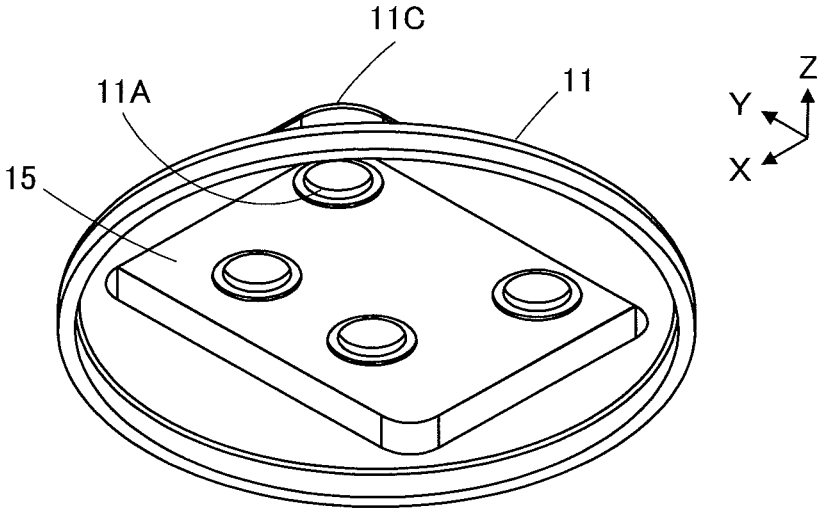
FIG. 15 is a perspective view of a housing used in the electronic device module according to Embodiment 2 as viewed from obliquely below.

Next, the housing 11 shown in FIG. 15 is put on the substrate 12, and the substrate 12 is fixed to the housing 11. At this time, the housing 11 is disposed on the substrate 12 such that the four terminal members 13 are accommodated in the raised portion 11C of the housing 11 and the four openings 11A of the housing 11 are located immediately above the openings 14D of the four contacts 14. The substrate 12 is fixed to the housing 11 such that the surfaces of the flanges 13D of the four terminal members 13 are tightly attached to the sheet type, insulating waterproof member 15 disposed on the inner surface 11B of the raised portion 11C of the housing 11.

Figure 16:
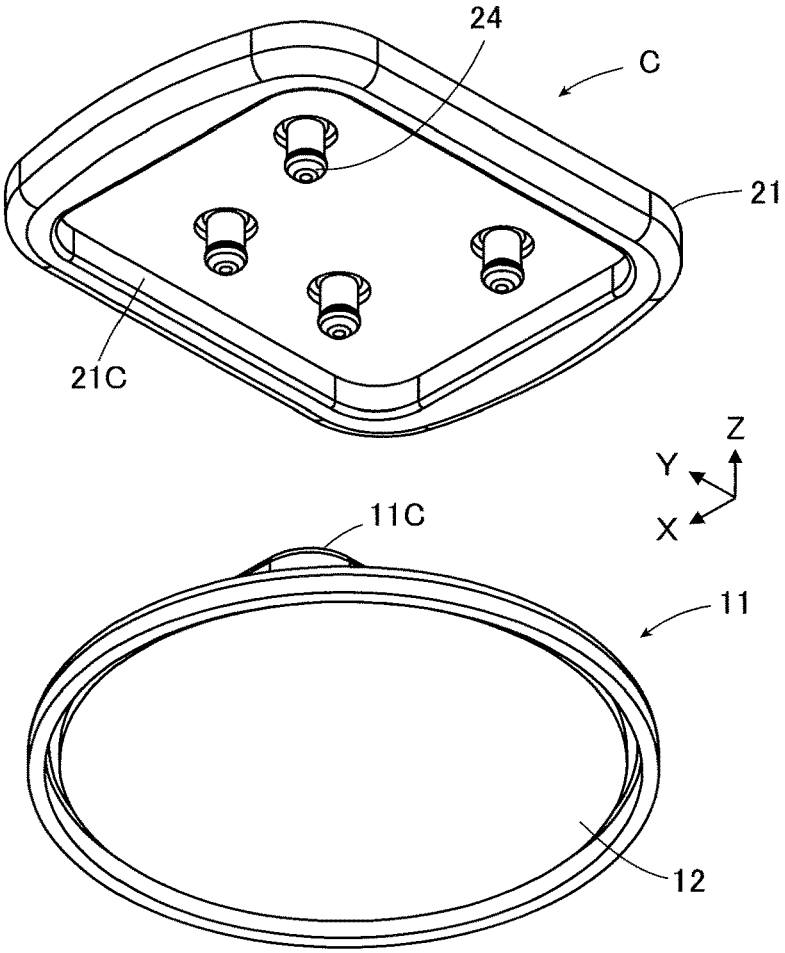
FIG. 16 is a perspective view showing the electronic device module according to Embodiment 2 and a garment-side connector in a non-fitted state.

The electronic device module M thus manufactured is fitted with a counter connector C shown in FIG. 16, whereby the electronic device module M and the counter connector C are connected to each other.

The counter connector C shown in FIG. 16 includes a housing 21 made of an insulating material such as an insulating resin, and the housing 21 is provided with a recess portion 21C having a shape conforming to the raised portion 11C of the housing 11. The counter connector C further includes four pin-shaped contacts (non-spring contact points) 24 projecting in the −Z direction in the recess portion 21C of the housing 21. The four contacts 24 are located in positions corresponding to the openings 14D of the four contacts 14 of the electronic device module M.

When the counter connector C and the electronic device module M as above are fitted to each other, the four contacts 24 of the counter connector C separately come into contact with the pairs of contact point portions 14C of the corresponding contacts 14 of the electronic device module M, whereby the contacts 24 are electrically connected to the corresponding contacts 14.

When the counter connector C is configured as a garment-side connector to be attached to a garment, the electric device module M can be used as a wearable device to be connected to the garment-side connector.

Embodiment 3

While the contact 14 used in Embodiment 1 includes the pair of contact point portions 14C that are elastically displaceable in the X direction parallel to the base portion 14A extending along an XY plane, the invention is not limited thereto.

Figure 17:
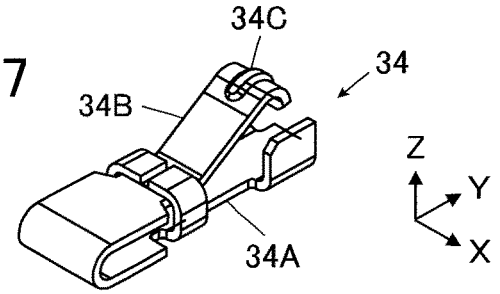
FIG. 17 is a perspective view showing a contact used in a waterproof terminal structure according to Embodiment 3.

FIG. 17 shows a contact 34 used in a waterproof terminal structure according to Embodiment 3. The contact 34 includes a base portion 34A extending along an XY plane and a single contact point portion 34C disposed at the tip of an arm portion 34B extending from the base portion 34A. The contact point portion 34C is configured to be elastically displaceable in the Z direction perpendicular to an XY plane.

Figure 18:
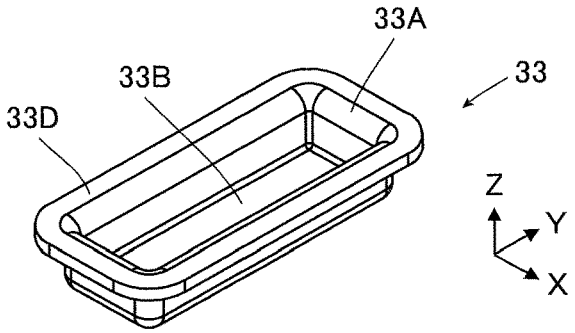
FIG. 18 is a perspective view showing a terminal member used in the waterproof terminal structure according to Embodiment 3.
Figure 19:
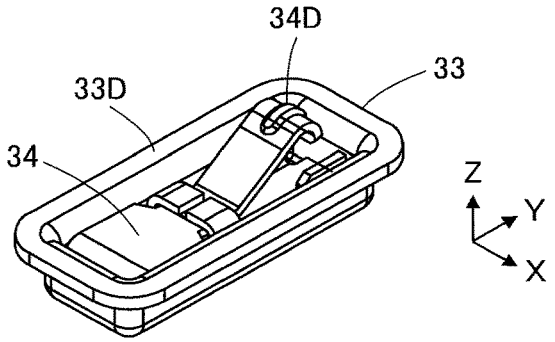
FIG. 19 is a perspective view of the terminal member in which a contact is incorporated in Embodiment 3.

The contact 34 is, in use, accommodated in a contact accommodation portion 33A of a terminal member 33 that has a so-called bathtub shape as shown in FIG. 18 and is formed from a sheet made of a conductive material such as metal. The contact 34 is incorporated in the terminal member 33 as shown in FIG. 19 by, for instance, welding the base portion 34A of the contact 34 to a bottom surface 33B of the contact accommodation portion 33A of the terminal member 33.

An outer surface of the contact accommodation portion 33A of the terminal member 33 is soldered to a wiring portion of the substrate 12, and a flange 33D formed along the circumference of the contact accommodation portion 33A of the terminal member 33 is tightly attached to the sheet type, insulating waterproof member 15 disposed on the inner surface 11B of the housing 11, thereby achieving the waterproof terminal structure having an excellent waterproof function, as with the waterproof terminal structure of Embodiment 1 shown in FIG. 1.

Since the contact point portion 34C of the contact 34 is elastically displaceable in the Z direction, it is preferable for a contact of a counter connector to have a contact point portion (non-spring contact point) extending along an XY plane. In a fitting process, the contact point portion of the contact of the counter connector comes into contact with the contact point portion 34C of the contact 34 at a predetermined contact pressure in the Z direction, and consequently the contact of the counter connector is electrically connected to the wiring portion (not shown) of the substrate 12 via the contact 34 and the terminal member 33.

Embodiment 4

While in the waterproof terminal structure of Embodiment 1 shown in FIG. 1, the contact 14 is accommodated in the contact accommodation portion 13A of the terminal member 13 in a so-called bathtub shape, the invention is not limited thereto.

Figure 20:
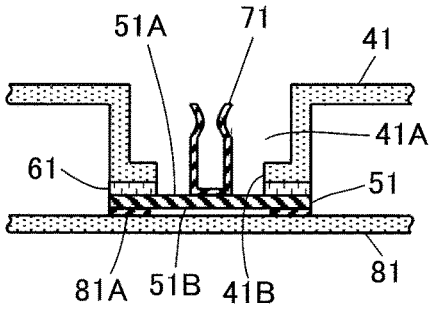
FIG. 20 is a cross-sectional view schematically illustrating a waterproof terminal structure according to Embodiment 4.

FIG. 20 schematically shows a waterproof terminal structure according to Embodiment 4. A housing 41 includes a recess-shaped contact accommodation portion 41A and an opening 41B formed in the bottom of the contact accommodation portion 41A, and a terminal member 51 of flat plate shape is tightly attached to an insulating waterproof member 61 disposed to surround the opening 41B of the housing 41.

The terminal member 51 is formed from a sheet made of a conductive material such as metal. Of a pair of surfaces of the sheet that face in the opposite directions, one surface 51A forms a contact connection portion having conductivity, while the other surface 51B forms a substrate mount portion having conductivity. The peripheral edge of the surface 51A forms a seal portion tightly attached to the waterproof member 61. A contact 71 having a spring contact point is accommodated in the contact accommodation portion 41A of the housing 41 and electrically connected to the surface 51A of the terminal member 51 through the opening 41B of the housing 41. The surface 51B of the terminal member 51 is electrically connected to a wiring portion 81A of a substrate 81.

Even with the configuration as above, the contact connection portion and the substrate mount portion of the terminal member 51 are electrically connected to each other and positioned such that water entering paths from the contact connection portion toward the substrate mount portion are all cut by the seal portion, thereby preventing water from entering the inside of the housing 41.

Embodiment 5

In the waterproof terminal structure of Embodiment 1 shown in FIG. 1, the bottom surface 13B of the contact accommodation portion 13A that is constituted of one of the pair of surfaces of the sheet forming the terminal member 13 forms the contact connection portion having conductivity, while the outer surface 13E of the contact accommodation portion 13A that is constituted of the other of the pair forms the substrate mount portion having conductivity; however, the invention is not limited thereto.

Figure 21:
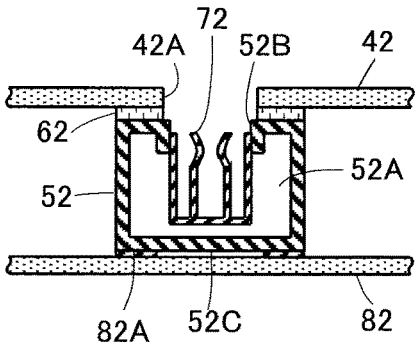
FIG. 21 is a cross-sectional view schematically illustrating a waterproof terminal structure according to Embodiment 5.

FIG. 21 schematically shows a waterproof terminal structure according to Embodiment 5. A terminal member 52 is formed from a sheet made of a conductive material such as metal and has a bathtub shape in which a contact accommodation portion 52A is formed. An opening 52B is formed in the terminal member 52, and a contact 72 having a spring contact point is accommodated in the contact accommodation portion 52A through the opening 52B.

Of a pair of surfaces of the sheet forming the terminal member 52 that face in the opposite directions, one surface 52C which is the outer surface of a box shape forms both a contact connection portion having conductivity and a substrate mount portion having conductivity. The contact connection portion is formed at the inner peripheral edge of the opening 52B, and the contact 72 is electrically connected to this contact connection portion. The substrate mount portion is formed at the outer surface of the bottom of the contact accommodation portion 52A and electrically connected to a wiring portion 82A of a substrate 82.

Of the surface 52C of the terminal member 52, a region surrounding the opening 52B forms a seal portion tightly attached to a waterproof member 62, whereby water entering paths from the contact connection portion toward the substrate mount portion are all cut by the seal portion.

In this manner, even with the configuration in which the contact connection portion and the substrate mount portion of the terminal member 52 are formed at the same surface 52C, the contact connection portion and the substrate mount portion are electrically connected to each other, while water entering paths from the contact connection portion toward the substrate mount portion are all cut by the seal portion. Thus, water can be prevented from entering the inside of the housing 42 by tightly attaching the seal portion of the terminal member 52 to the waterproof member 62.

Figure 22:
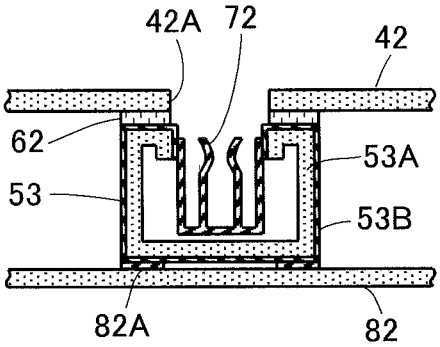
FIG. 22 is a cross-sectional view schematically illustrating a waterproof terminal structure according to a modification of Embodiment 5.

In Embodiment 5, since the contact connection portion and the substrate mount portion of the terminal member 52 are formed at the same surface 52C, the terminal member 52 formed from a sheet made of a conductive material such as metal may be replaced by a terminal member 53 formed from a sheet including a terminal member body 53A made of an insulating material such as an insulating resin and a conductive layer 53B formed on a surface of the terminal member body 53A as shown in FIG. 22. The sheet is used with the conductive layer 53B being located on the outer side of the box shape, and the conductive layer 53B forms the contact connection portion and the substrate mount portion. In other words, the conductive layer 53B is electrically connected with the contact 72 and electrically connected with the wiring portion 82A of the substrate 82.

Even with this configuration, a waterproof function can be achieved as with the waterproof terminal structure of Embodiment 5 shown in FIG. 21. The terminal member 53 can be easily manufactured by, for example, shaping insulating resin to produce the terminal member body 53A and coating a conductive material on the surface of the terminal member body 53A.

Embodiment 6

In the waterproof terminal structure of Embodiment 1 shown in FIG. 1, the substrate 12 is disposed in the housing 11 such that the flange 13D of the terminal member 13 is pressed against and tightly attached to the sheet type, insulating waterproof member 15 disposed on the inner surface 11B of the housing 11; however, the invention is not limited thereto.

Figure 23:
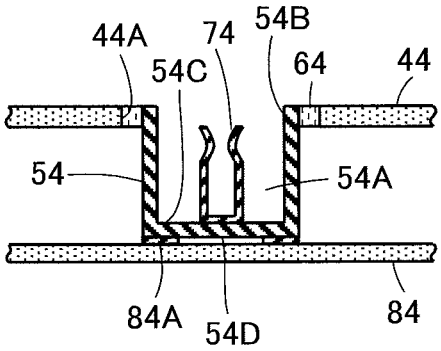
FIG. 23 is a cross-sectional view schematically illustrating a waterproof terminal structure according to Embodiment 6.
Figure 24:
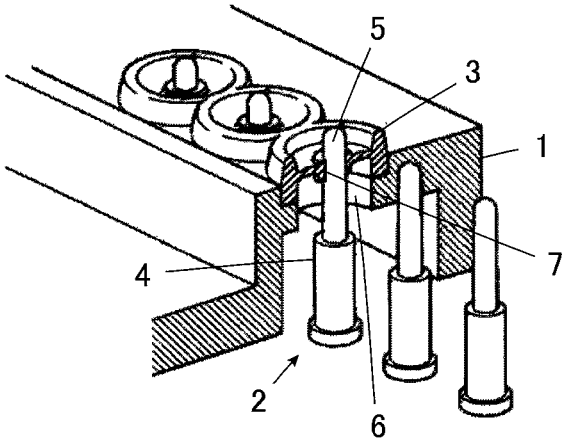
FIG. 24 PRIOR ART
FIG. 24 is a partially broken perspective view showing a conventional waterproof terminal structure.

FIG. 23 schematically shows a waterproof terminal structure according to Embodiment 6. A terminal member 54 is formed from a sheet made of a conductive material such as metal and has a bathtub shape in which a contact accommodation portion 54A is formed. An opening 54B is formed in the terminal member 54, and a contact 74 having a spring contact point is accommodated in the contact accommodation portion 54A through the opening 54B.

The outer peripheral edge of the opening 54B of the terminal member 54 forms a seal portion located along the inner periphery of an opening 44A of a housing 44. At the inner peripheral portion of the opening 44A of the housing 44, an insulating waterproof member 64 is disposed along the circumference of the opening 44A. The seal portion of the terminal member 54 can be tightly attached to the waterproof member 64 by, for instance, pressing the terminal member 54 into the inside of the waterproof member 64.

Of a pair of surfaces of a sheet forming the terminal member 54 that face in the opposite directions, one surface 54C forms a contact connection portion having conductivity, while the other surface 54D forms a substrate mount portion having conductivity. The surface 54C is electrically connected with the contact 74, and the surface 54D is electrically connected with a wiring portion 84A of a substrate 84.

In this manner, even with the configuration in which the seal portion of the terminal member 54 is tightly attached to the waterproof member 64 disposed at the inner peripheral portion of the opening 44A of the housing 44, the contact connection portion formed at the surface 54C of the terminal member 54 and the substrate mount portion formed at the surface 54D of the terminal member 54 are electrically connected to each other, while water entering paths from the contact connection portion toward the substrate mount portion are all cut by the seal portion, thereby preventing water from entering the inside of the housing 44.

What is claimed is:

1. A waterproof terminal structure including a contact having a spring contact point, the waterproof terminal structure comprising:

a terminal member that holds the contact, the terminal member including:

a contact connection portion having conductivity and connected to the contact;

a seal portion tightly attached to an insulating waterproof member disposed at least along a circumference of an opening of a housing; and a substrate mount portion having conductivity and connected to a wiring portion of a substrate, wherein the contact connection portion and the substrate mount portion are electrically connected to each other and positioned such that a water entering path from the contact connection portion toward the substrate mount portion is cut off by the seal portion, and wherein the contact does not penetrate the terminal member.

2. The waterproof terminal structure according to claim 1, wherein the terminal member is formed from a sheet made of a conductive material and having a pair of surfaces that face in opposite directions, wherein the contact connection portion is disposed on one of the pair of surfaces of the sheet, and wherein the substrate mount portion is disposed on the other of the pair of surfaces of the sheet.

3. The waterproof terminal structure according to claim 2, wherein the terminal member has a bathtub shape in which a contact accommodation portion of recess shape is formed, wherein the contact is accommodated in the contact accommodation portion of the terminal member, wherein the contact connection portion is disposed on a bottom surface of the contact accommodation portion, and wherein the substrate mount portion is disposed on an outer surface of the contact accommodation portion that is located on a reverse side of the bottom surface of the contact accommodation portion.

4. The waterproof terminal structure according to claim 3, wherein the terminal member includes a flange that overhangs from an edge of the contact accommodation portion in parallel to the bottom surface along a circumference of the contact accommodation portion, and wherein the seal portion is formed from a surface of the flange.

5. The waterproof terminal structure according to claim 1, wherein the terminal member is formed from a sheet including a terminal member body made of an insulating material and a conductive layer formed on a surface of the terminal member body, and wherein the contact connection portion and the substrate mount portion are formed from the conductive layer of the sheet.

6. An electronic device module comprising:

a housing having an opening;

an insulating waterproof member disposed at least along a circumference of the opening of the housing;

a substrate disposed in the housing and having on its surface a wiring portion;

a terminal member fixed to the substrate; and a contact having a spring contact point and held in the terminal member, without penetrating the terminal member, such that the spring contact point is exposed through the opening of the housing, the terminal member including:

a contact connection portion having conductivity and connected to the contact;

a seal portion tightly attached to the insulating waterproof member; and a substrate mount portion having conductivity and connected to the wiring portion of the substrate, wherein the contact connection portion and the substrate mount portion are electrically connected to each other, and a water entering path from the contact connection portion toward the substrate mount portion is cut off by the seal portion, and wherein water is prevented from entering an inside of the housing by tightly attaching the seal portion of the terminal member to the insulating waterproof member.

7. The electronic device module according to claim 6, wherein the electronic device module is used as a wearable device by electrically connecting the spring contact point of the contact with a non-spring contact point of a garment-side connector.

* * * * *